US005945628A

United States Patent [19]

Roheim

[11] Patent Number: 5,945,628

[45] Date of Patent: Aug. 31, 1999

[54] DEVICE FOR A GRENADE PRESSURE PLATE AND SEALING MEANS FOR A PRESSURE PLATE OF A GRENADE

[75] Inventor: Karl-Axel Roheim, Nynäshamn, Sweden

[73] Assignee: Roheim System, Nynäshamn, Sweden

[21] Appl. No.: 08/952,307

[22] PCT Filed: Apr. 26, 1996

[86] PCT No.: PCT/SE96/00556

§ 371 Date: Nov. 5, 1997

§ 102(e) Date: Nov. 5, 1997

[87] PCT Pub. No.: WO96/35094

PCT Pub. Date: Nov. 7, 1996

[30] Foreign Application Priority Data

May 5, 1995 [SE] Sweden ..... 9501309

[51] Int. Cl.[6] ..... F42B 15/00

[52] U.S. Cl. ..... 102/483; 102/372; 42/105; 89/1.818

[58] Field of Search ..... 102/372, 373, 102/432, 445, 482, 483, 520, 523–527; 42/105; 89/14.6, 1.818

[56] References Cited

U.S. PATENT DOCUMENTS

| | | | |
|---|---|---|---|
| 1,044,360 | 11/1912 | DuBois | 102/526 |
| 1,311,006 | 7/1919 | Post | 102/483 |
| 3,915,091 | 10/1975 | Smith et al. . | |
| 4,611,540 | 9/1986 | Pettersson et al. | 102/372 |
| 5,175,393 | 12/1992 | Andersson . | |

FOREIGN PATENT DOCUMENTS

| | | | |
|---|---|---|---|
| 466281 | 7/1950 | Canada | 102/372 |
| 0120215 | 3/1984 | European Pat. Off. . | |
| 774170 | 12/1934 | France | 102/523 |
| 3544946 | 6/1987 | Germany | 102/527 |
| 100432 | 5/1916 | United Kingdom | 102/483 |

*Primary Examiner*—Harold J. Tudor
*Attorney, Agent, or Firm*—Jacobson, Price, Holman & Stern, PLLC

[57] ABSTRACT

In a shell thrower, a grenade is inserted in a barrel and a booster charge under the grenade will fire and generate a gas pressure which forces the grenade out of the barrel. To improve the driving charge acting on the grenade, a pressure plate is detachably fixed under the grenade, and the booster charge is located on the underneath side of the pressure plate. An ignition mechanism for the booster charge is arranged on the underneath side of the pressure plate, which ignition mechanism is initiated by the impact of the pressure plate against the bottom or a shoulder of the barrel. A releasable engagement is arranged between the upper side of the pressure plate and the bottom of the grenade, which engagement includes a locking device, which is released from its locking position by a part of the driving pressure of the booster charge.

7 Claims, 2 Drawing Sheets

DEVICE FOR A GRENADE PRESSURE PLATE AND SEALING MEANS FOR A PRESSURE PLATE OF A GRENADE

The present invention relates to a sealing means for a grenade of a shell thrower, where the grenade is inserted in the barrel and a booster charge under the grenade is fired to generate a gas pressure, which drives the grenade out of the barrel.

An object of the present invention is to improve the power of the booster charge on the grenade so that there is a possibility to arrange a sealing between the grenade or a part of the grenade and the bore of the barrel. It is thereby possible to use most of the gas pressure of the fired booster charge for ejecting the grenade.

The invention will be described in the following by reference to the enclosed drawings.

Figure 1:
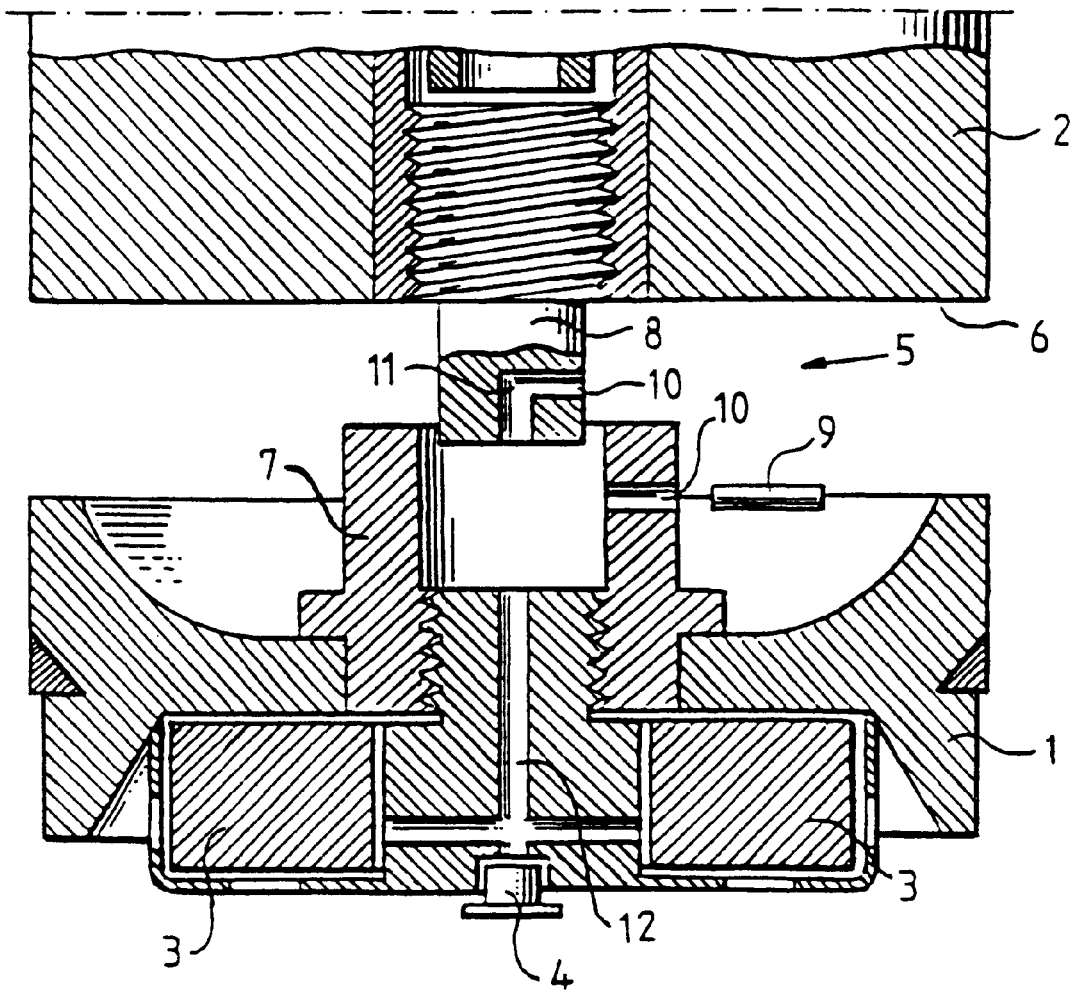
FIG. 1 shows a longitudinal section of the lower part of the grenade and its pressure plate.

FIG. 1 shows the lower part 2 of a grenade schematically. A pressure plate 1 is detachably fixed on the bottom of the grenade and the pressure plate includes a booster charge 3. The booster charge is placed on the underside of the pressure plate. An ignition mechanism 4 for the booster charge is arranged on the underside of the pressure plate and could be a common blasting cap, which is initiated by an impact. The ignition mechanism or the blasting cap 4 is initiated when the pressure plate is inserted together with the grenade 2 in the barrel and hits the bottom of the barrel or a stop pin in the barrel.

A releasable engagement 5 connects the pressure plate 1 with the underside 6 of the grenade 2. This releasable engagement 5 consists of a sleeve 7 which is fixed to the upper side of the pressure plate. A pin 8 is inserted from above in the sleeve, which pin, for instance, is threaded into the bottom 6 of the grenade 2. A locking pin 9 is inserted in a bore 10, which is extended through the sleeve 7 and into the pin 8. The bottom 11 of the bore 10 is connected with a channel 12, which is extended through the pressure plate to the bottom of the sleeve 7.

The operation of the pressure plate is as follows. When the booster charge is initiated by the ignition mechanism 4 and thus is fired, a gas pressure is generated, the main object of which is to eject the pressure plate together with the grenade out of the barrel. A part of the driving pressure of the booster charge will however be conducted by the channel 12 to the bottom 11 of the bore 10 in the pin 8. The locking pin 9 will hereby be driven out of the bore 10 and the pressure plate is released from the grenade. Because the pressure plate is smaller and lighter than the grenade, the pressure plate, after having left the barrel together with the grenade, will fall down to the ground just outside the barrel whereas the grenade 2 will proceed from the shell thrower in a certain path.

Figure 2:
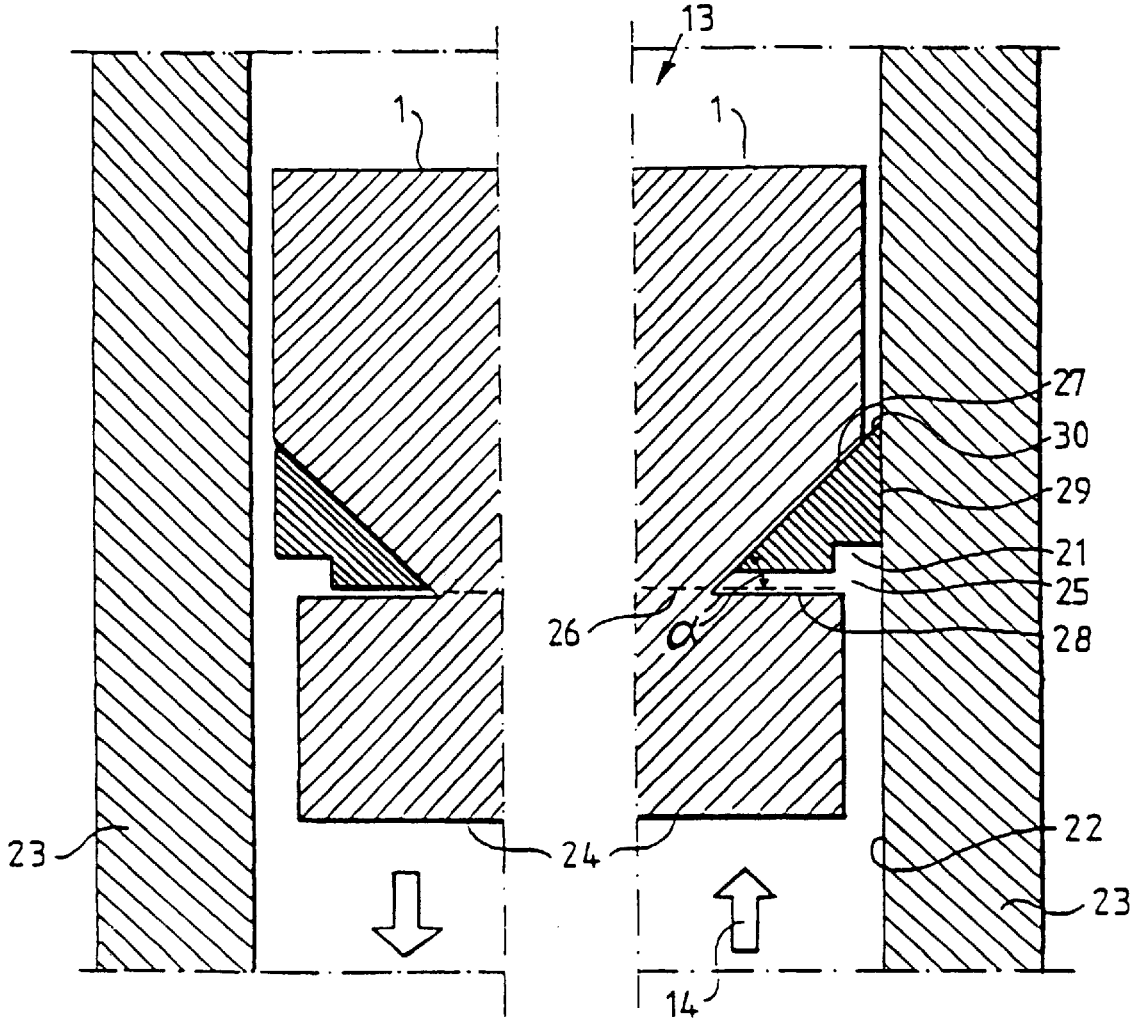
FIG. 2 is a longitudinal schematic section of the pressure plate and a part of the surrounding barrel and shows the function of the pressure plate as a valve when the grenade is fired. The left side of FIG. 1 shows the form of the valve when the pressure plate is inserted in the barrel.
Figure 4:
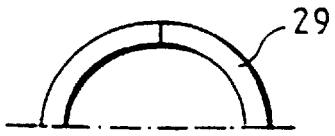
FIG. 4 is a view of the form of the valve element in its rest position and in a smaller scale than in FIG. 2.
Figure 3:
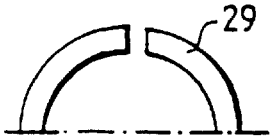
FIG. 3 is a plan view of the valve element in the firing position but in a smaller scale than in FIG. 2.

FIGS. 2–4 shows the pressure plate operating as a sealing valve 13.

The pressure plate (the sealing valve) includes a valve element 29, which is located in a groove 25 in the envelope surface of the pressure plate 1. The groove 25 is beveled from its upper edge 27 so that the upper inner side of the edge forms an angle α with the diametrical plane 26. The valve element 29 mounted in the groove 25 has a beveled upper side 30 corresponding to the slope of the side 27 of the groove. The valve element 29 is spring expanding which means that when there is a pressure from underneath, see arrow 14, it will be forced upwards and outwards out of the groove and thereby against the inside of the barrel 23, which causes a seal so that the gas pressure cannot pass between the pressure plate 1 and the inside of the barrel 23.

The valve element is thus spring expanding, which means that when there is no pressure from underneath it will be in the form shown in the left side of FIG. 2. This also means that when the shell thrower is loaded and a grenade with its pressure plate is inserted from above into the barrel, the air, which will be compressed under the pressure plate, will pass between the pressure plate and the inside of the barrel.

The spring property or the elastic property of the valve element is now adjusted so that when a high gas pressure is generated by firing the grenade, and the gas pressure is directed towards the side 21 of the valve element which is faced downwards, the valve element will slide against the beveled side 27 and be displaced against the inner side of the barrel. A high pressure is needed for this and FIG. 3 shows that the valve element is divided by a radially extending cut so that it can expand.

Preferably the pressure plate is so formed that the lower end part, which is under the groove 25 and is faced to the gas pressure, has a less diameter (see FIG. 2) in order to ensure that enough pressure will reach the free side 21 of the valve element. The main part of the gas pressure will strike the underneath side 24 of the pressure plate but enough gas pressure must thus pass around the pressure plate and reach the valve element 29.

The size of the angle α has an influence on the pressure which forces the valve element against the inner side 22 of the barrel when firing the booster charge. The valve element can be produced from many different materials as plastic, rubbers steel or other metals depending on the type of booster charge and the force from the booster charge.

I claim:

1. A sealing system for a grenade of a shell thrower, the grenade having a top end and a bottom end, the bottom end being inserted in a barrel of the shell thrower having a bottom, the sealing system comprising:

a booster charge located under the grenade for firing and generating a driving pressure to force the grenade out of the barrel of the shell thrower, a pressure plate having an upper side and an underneath side being detachably fixed under the grenade, said booster charge being located on said underneath side of said pressure plate so that said driving pressure acts directly on the underneath side of the pressure plate rather than on the bottom end of the grenade, an ignition mechanism being connected with said booster charge and being arranged on the underneath side of said pressure plate, said ignition mechanism being initiated by the impact of said pressure plate against said bottom or against a shoulder of the barrel of the shell thrower, a releasable engagement between said upper side of said pressure plate and the bottom end of said grenade, said engagement including a sliding locking device having a locking position and a releasing position, said locking device being released from said locking position by a part of the driving pressure of the booster charge acting on said locking device.

2. The sealing system according to claim 1, wherein said pressure plate is formed with a channel extending from the booster charge to a sleeve on said upper side where there is a stud on the bottom end of the grenade, the-stud is insertable in said sleeve, and said locking device is a pin, insertable from a side of the sleeve into said stud in a bore through said sleeve, and a bottom end of said bore being connected with said channel extending through the pressure plate.

3. The sealing system according to claim 1, wherein said pressure plate has a surrounding groove in an enveloping surface, the groove is located in a diametrical plane, and the groove has two groove sides, one of the two grooves sides facing a pressure side is inclined from a pressure end of the pressure plate in an outward direction from an inner end of the groove, forming a predetermined angle with the diametrical plane, and a ring-shaped valve element is located in the groove the valve element is spring expanding in a radial outward direction and has a surface extending parallel to said one inclined groove side and sliding on said inclined groove side, and the valve element has a second face, at least partly facing the pressure end of the pressure plate and is free from the groove so that gas pressure can act against said face, whereby the valve element when sliding on the inclined groove side will expand to contact an inner side of the barrel by action of the gas pressure and will retain an original form when the gas pressure is released.

4. A sealing system according to claim 3, wherein the predetermined angle with the diametrical plane is substantially 40°.

5. A sealing system according to claim 3, wherein a cross section of the valve element is triangular.

6. A sealing system according to claim 3, wherein a diameter of the pressure plate is less on the pressure side underneath said groove than a diameter of the upper part of the pressure plate.

7. A sealing system according to claim 3, wherein the valve element is divided to be extendable in a radial direction.

* * * * *